US005252147A

United States Patent [19]

Verhoeven et al.

[11] Patent Number: 5,252,147

[45] Date of Patent: Oct. 12, 1993

[54] MODIFICATION OF SURFACE PROPERTIES OF COPPER-REFRACTORY METAL ALLOYS

[75] Inventors: John D. Verhoeven; Edwin D. Gibson, both of Ames, Iowa

[73] Assignee: Iowa State University Research Foundation, Inc., Ames, Iowa

[21] Appl. No.: 655,236

[22] Filed: Feb. 11, 1991

Related U.S. Application Data

[63] Continuation of Ser. No. 366,660, Jun. 15, 1989, abandoned.

[51] Int. Cl.[5] ..... C23C 8/02; C23C 26/00

[52] U.S. Cl. ..... 148/237; 148/281; 148/282; 148/536; 148/316; 148/317; 428/610; 428/614; 428/674

[58] Field of Search ..... 148/11.5 C, 11.5 F, 148/11.5 Q, 13.2, 20.3, 127, 278, 282, 284, 281, 536, 317, 316; 420/495; 428/610, 614, 674, 930

[56] References Cited

U.S. PATENT DOCUMENTS

| | | | |
|---|---|---|---|
| 2,025,662 | 12/1935 | Hensel et al. | 75/1 |
| 2,033,709 | 2/1936 | Hensel et al. | 148/32 |
| 4,378,330 | 3/1983 | Verhoeven et al. | 420/432 |
| 4,532,703 | 8/1985 | Verhoeven et al. | 420/495 |
| 4,575,451 | 3/1986 | Naya et al. | 420/495 |
| 4,600,448 | 7/1986 | Schmidt et al. | 420/495 |
| 4,626,282 | 12/1986 | Naya et al. | 420/495 |
| 4,687,883 | 8/1987 | Flükiger et al. | 148/11.5 F |
| 4,818,283 | 4/1989 | Grünthaler | 148/13.2 |

FOREIGN PATENT DOCUMENTS

| | | | |
|---|---|---|---|
| 252357 | 6/1964 | Australia . | |
| 61-024105 | 1/1986 | Japan | 148/127 |
| 582236 | 11/1946 | United Kingdom . | |

OTHER PUBLICATIONS

Japan (I) Abstract 58-037,103 Mar. 1983.

Japan (II) Abstract 60-145,371 Jul. 1985.

W. A. Darrah, "Controlled Atmospheres for Copper", *Steel,* Jul. 1937.

Schulze et al, "High-Temperature Interaction of Refractory Metals with Gases", JOM Oct. 1988, pp. 25-31.

James P. Harbison & J. Bevk, Superconducting and mechanical properties of in situ formed multifilamentary Cu-$Nb_3Sn$ composites, May 1977.

J. Bevk and W. A. Sunder, Mechanical Properties of Cu-Based Composites With In Situ Formed Ultrafine Filaments, 1982.

C. L. Trybus, W. A. Spitzig, J. D. Verhoeven and F. A. Schmidt, Characteristics Of P/M Processed Cu-Nb Composites, 1988.

*Primary Examiner*—R. Dean

*Assistant Examiner*—Margery S. Phipps

*Attorney, Agent, or Firm*—Tilton, Fallon, Lungmus & Chestnut

[57] ABSTRACT

The surface properties of copper-refractory metal (CU-RF) alloy bodies are modified by heat treatments which cause the refractory metal to form a coating on the exterior surfaces of the alloy body. The alloys have a copper matrix with particles or dendrites of the refractory metal dispersed therein, which may be niobium, vanadium, tantalum, chromium, molybdenum, or tungsten. The surface properties of the bodies are changed from those of copper to that of the refractory metal.

13 Claims, No Drawings

MODIFICATION OF SURFACE PROPERTIES OF COPPER-REFRACTORY METAL ALLOYS

CONTRACTUAL ORIGIN OF THE INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

This is a continuation of copending application Ser. No. 07/366,660 filed on Jun. 15, 1989, now abandoned.

FIELD OF INVENTION

The field of this invention is alloys of copper with refractory metals, the alloy containing the refractory metal as dendrites, particles or filaments. The invention is particularly concerned with modification of the surface properties of copper-refractory metal alloy bodies.

BACKGROUND OF INVENTION

Because of its electrical and heat conducting properties, copper has many important uses in the form of wire, sheet, etc. However, pure copper has relatively weak tensile strength. One promising approach to improving the strength of copper is to mix it with a non-alloying ductile phase and mechanically reduce it in size. Such multi-phase copper alloy mixtures have been referred to as "in-situ" composites or deformation processed composites. The alloying metal is present as an array of elongated particles.

It has been demonstrated that quite high strength copper-X alloys can be produced by alloying copper with elements where X is an element such as niobium and vanadium, or other refractory metal. See Harbison and Bevk technical article entitled "Superconducting and mechanical properties of in situ formed multifilamentary Cu-$Nb_3Sn$ composites", American Institute of Physics (1977); and Bevk, et al. technical article entitled "Mechanical Properties of Cu-Based Composites With In-Situ Formed Ultrafine Filaments", IN SITU COMPOSITES IV, Elsevier Publishing Co., Inc. (1982). High strength sheets or wires may be fabricated by a casting and mechanical reduction process or by powder processing and mechanical reduction. The casting is first produced as a microstructure of X dendrites in a Cu matrix, and the alloy can then be mechanically reduced by either rolling or drawing operations. This kind of mechanically worked copper composite alloy is described by Downing, et al. (1987), and Verhoeven, et al. U.S. Pat. No. 4,378,330. In the powder processing technique powders of Cu and X are mixed and compacted followed by mechanical reduction. See Trybus, et al. (1988) *Processing and Properties for Powder Metallurgy Composites*, pp. 97–105, Ed. P. Kumar, K. Vedula and A. Ritter, The Metallurgy Society AIME.

These Cu-X deformation processed alloys are quite ductile and may be mechanically reduced to very large drawing strains without breakage. Mechanical reduction, such as by drawing, extrusion, or rolling, converts the X particles into elongated filaments, which serve to reinforce and greatly increase the strength of the formed wire, sheet, or other configuration.

It is known that alloys of copper with refractory metals such as chromium have their mechanical properties improved by a heat treatment, which is sometimes referred to as "age hardening". Refractory metals are slightly soluble in the copper matrix. By relatively low temperature heat treatment, refractory metal in solid solution can be caused to separate in the form of minute particles which collect throughout the volume of the Cu matrix. This is in addition to any large refractory metal particles which may be present in the Cu matrix if the composition of X is above around 0.5%. Age hardening can improve the mechanical strength of such alloys.

Temperatures most effective for age hardening of alloys are from about 350° to 550° C., but broader temperature ranges have been disclosed in several patents. These alloys are referred to herein as copper-refractory metal composite alloys (Cu-RF) alloys. U.S. Pat. Nos. 2,025,662 and 2,033,709 of Hensel, et al. disclose copper-chromium alloys containing 0.8 to 2.54, or 0.01 to 5% cbromium. As described in these patents, following casting of the alloys and while they are still in a molten state, some chromium tends to separate, rising to the top of the castings by density segregation, chromium being lighter than copper. Rapid cooling is proposed to minimize such segregation. After the castings have been formed and solidified, a heat treatment at 250° to 600° C. is described. This reheating or aging step is said to cause precipitation of the dissolved chromium, which becomes distributed in extremely small particles, and produces age hardening.

British Pat. No. 582,236 also relates to the preparation of copper-chromium alloys. It is stated that the chromium content may range from 1 to 35%. After casting of the alloy, it is subjected to a heat treatment, described as an annealing treatment carried out at a temperature between 400° and 7500C. for one-half hour and up to 8 hours, to produce age hardening.

Australian Pat. No. 252,357 relates to copper-based alloys containing chromium and/or zirconium. It is stated that an age-hardening treatment has been proposed in which similar alloys are heated to temperatures of 700° to 1000° C. For the preparation of an alloy containing both chromium and zirconium, it is proposed to carry out a heat treatment from above 1000° C. up to the solidus temperature of the alloy, followed by rapid quenching and thereafter aging of the alloy at a temperature of from 300° to 5000° C. to produce age hardening.

The above-described patent references do not specify the use of an inert atmosphere in carrying out the heat treatments described therein. Further, the heat treatments are not described as modifying any surface properties of the alloys. Their function is to improve mechanical properties by age hardening.

SUMMARY OF INVENTION

This invention is based in part on the discovery of a novel and heretofore unrecognized effect of heat treatment on CU-RF alloys-in which the copper is a major component, forming the matrix of the alloy, and the refractory metal is dispersed in the form of dendrites, particles or filaments. By heating such alloy bodies at a temperature effective for reducing the energy of the body surfaces, the refractory metal can be caused to redistribute and form thin layers on the exterior surfaces of the body. The redistribution by surface energy reduction occurs at the atomic level, and does not require that the copper matrix is in liquid condition.

The liquidus temperature of the copper matrix is approximately 1080° C. The surface coatings of the refractory metal can be formed by heating at temperatures well below 10800° C., such as 650° to 10000° C. Refractory metal coatings of at least 52 to 100 angstroms thickness can be formed, providing that the heat treatment is conducted under an ambient atmosphere that is non-reactive with the metals of the alloy.

Either as a subsequent separate heat treatment, or as a continuation of the initial coating-forming heat treatment, the refractory metal layers on the exterior surfaces can be caused to increase substantially in thickness by a further heat treatment at a temperature above IOBOOC, such as from 1100° to 1250° C. Although the maximum temperature usable for this further heating has not been precisely established, and may vary somewhat with the particular CU-RF alloy, it is believed that in general the second heat treatment should be carried out at a temperature below 1300° C.

For practicing the second heat treatment while avoiding configurational changes in the alloy bodies, it has been found that the initially formed surface coatings of the refractory metal can assist in maintaining the shape of the bodies being heat treated. This advantage is particularly evident for small bodies such as thin sheets or small diameter wires.

It has been further found that not all refractory metals can be used in copper base alloys where it is desired to modify surface properties by the method of this invention. The preferred refractory metals, as presently known, are niobium, vanadium, tantalum, chromium, molybdenum, and tungsten. With these metals, initial RF surface coatings of at least 100 to 200 angstroms can be formed, and such coatings can be thickened by subsequent heat treatment to at least 0.5 to 1 micron.

The refractory metals of the CU-RF alloys have markedly different chemical properties than the matrix copper. Consequently, the forming of RF coatings on the alloy bodies changes the chemical properties of the surfaces of these bodies. The refractory metals are less subject to corrosion than the copper, and are less electrically conductive. Further, after the refractory metal coatings are formed, they can be reacted with other chemical substances, such as oxidizing, carburizing or nitriding agents.

DETAILED DESCRIPTION

The method of this invention may be practiced with copper-X composite alloys in which the X metal is a refractory metal selected from niobium (Nb), vanadium (V), tantalum (Ta), chromium (Cr), molybdenum (Mo) and tungsten (W) or any combination of these metals. Such alloys are composed of a copper matrix in which there is dispersed a second phase, comprising particles of the refractory metal. Such alloys may be formed by conventional melting, fusing, and casting procedures. Verhoeven, et al. U.S. Pat. No. 4,378,330 describes a Cu-Nb alloy which is representative of this class of alloys. Others of the listed refractory metals can be substituted for the niobium using the process described in the cited patent.

As an alternative to conventional melting or casting, the CU-RF alloy may be formed by a consumable arc melting method, as described in Verhoeven, et al. U.S. Pat. No. 4,481,030. In that process, a consumable electrode is prepared which has a copper matrix with a plurality of dendrite-forming "X" metal strips embedded therein. The electrode is subjected to direct current arc melting in an enclosed chamber containing an inert gas. Reduced gas pressures can be employed for most of the refractory metals. However, for more refractory high melting point metals, superatmospheric pressure may be used as described in Verhoeven, et al. (1986), *J. Metals*, pp. 10–24. An elevated pressure process is particularly advantageous for forming alloys of copper with molybdenum or tungsten. Inert gas pressure around the electrode should be sufficient to suppress boiling of liquid copper at the liquidus temperature of the alloy being produced.

A further alternative method for producing such composite alloys is described in Verhoeven et al. Pat. No. 4,770,718. After the CU-RF alloy has been initially prepared, it is melted and formed into fine droplets. The operation is carried out within an enclosed chamber containing an inert gas atmosphere. The molten droplets are dispersed into the inert gas, and are rapidly solidified, either while gas-borne or by impingement on a cool surface. Small droplets or platelets are formed, which are collected and compressed into integrated bodies.

A further alternative method for producing such composite alloys is described in Trybus, et al. (1988), pp. 97–105, cited above. In this case the Cu-RF alloy is prepared by mixing and compacting powders of Cu and the RF metal or alloy.

The method of this invention may be practiced with CU-RF alloy bodies prepared by any of the above-described methods. The method may be applied to the alloy body, as initially formed, or after the alloy body has been subjected to mechanical reduction, thereby aligning the RF dendrites in filamentary form. In preferred embodiments, the method is applied to alloy bodies having aligned RF filaments, as produced by mechanical reduction or in some applications by a casting procedure in which directional solidification is employed.

The method of this invention involves a controlled heating procedure for the purpose of modifying the surface properties of the copper-refractive metal alloy bodies. The purpose of the heating is to increase the diffusion coefficient of the RF metal atoms. This allows the system to reduce its total energy by reducing its surface energy. The refractory metal atoms migrate by means of the increased diffusion coefficient and rearrange themselves on the surfaces of the bodies, thereby forming coating layers which have a reduced surface energy. In forming an initial coating of the refractory metal, it is important that the heating be carried out under an ambient atmosphere non-reactive with the metals of the alloy. For example, the heating may be conducted under an atmosphere of inert gas, such as argon or helium, or carried out in an evacuated space with a vacuum sufficiently high to avoid air reaction with the metals of the alloy.

The initial heat treatment for forming refractory metal layers on the surfaces of the bodies is carried out at a temperature above 6000° C. but below the liquidus temperature of the Cu matrix. Since the matrix has an approximate liquidus temperature of 10800° C., it is preferred to carry out the heating at a temperature substantially below 10800° C., such as temperatures up to 10500° C. Preferred temperatures for the initial heat treatment are from about 6500° C. to 10500° C.

The heating of the alloy body is continued until visibly apparent layers of the refractory metal are present on the exterior surfaces of the bodies. For example, the RF layers formed by the heating may have a thickness of 52 angstroms or better, such as preferably at least 100 angstroms.

After the bodies have been coated with the refractory metal in the initial heat treatment as described above, the coating layer may be substantially increased in thickness by further or second heat treatment. The second heat treatment may be carried out separately, that is, after cooling the bodies from the first heat treatment, or may be carried out continuously, the first and second heat treatments being sequential. The second heat treatment is at a temperature above the liquidus temperature of the Cu matrix and preferably below 13000° C. The presently preferred temperature range for the further heat treatment is from about 1100° to 1250° C.

The further heating may be carried out under an inert atmosphere, as described above with reference to the first heat treatment. However, if desired, in the second heat treatment the atmosphere may contain a substance reactive with the RF coating, although usually it will be preferred to complete the preparation of the coating, and subsequently react it with chemical substances to further modify its properties.

The second heat treatment is preferably continued until RF layers of a thickness of at least 0.5 microns. However, the second heat treatment can be continued to produce thicker coatings, up to at least 1 to 2 microns, or in some embodiments, up to 10 to 15 microns.

The alloy may contain from 1 to 90% by volume of the RF. in most embodiments, however, the RF component will be a minor proportion by volume of the total alloy. For example, the refractory metal may be present in an amount of 1 to 40% by volume, the copper matrix comprising 60 to 99% by volume. In certain preferred embodiments, the RF content is 10 to 25% by volume with a corresponding Cu matrix content of 75 to 90%.

The length of time employed for the initial heat treatment or for the further heat treatment can vary from a few minutes to several hours. Further, if needed, either the initial heat treatment or the further heat treatment can be repeated in order to obtain a thicker initial RF layers, or to increase the thickness of the initially formed layers. The required heating time to produce a layer of particular thickness will vary somewhat with the specific refractory metal and also with the temperature employed.. In general, as the temperature is increased within the ranges specified for the heat treatment, the rate of formation of the coatings will increase. A representative range of heating times for the first heat treatment is from about 20 to 500 minutes, and for the second heat treatment from about 1 to 24 hours.

The method of this invention is further illustrated by the following examples.

EXAMPLE 1

An alloy of 80% by volume copper and 20% by volume niobium was prepared by the consumable arc casting method, and rolled to a 1 mm thick sheet. The resulting alloy sheet had a copper matrix with dendritic filaments of niobium. The alloy sheet was sealed in a quartz tube under an inert atmosphere of helium at about 12 psi pressure. It was heated to 8000° C., and the temperature held for 6 hours. The furnace was then turned off and the alloy allowed to cool.

A dramatic change in the color of the sheet surfaces had occurred. Both surfaces of the sheet no longer showed the characteristic yellow-orange color of copper. Instead, as the surfaces were coated with a layer of niobium, displaying the characteristic metallic luster of niobium. Analysis with an energy dispersive x-ray spectrometer showed the niobium surface coatings to have a thickness of about 100 angstroms.

EXAMPLE 1*a*

An alloy of 80% by volume of Cu and 20% by volume of Nb was prepared by mixing powders of Cu and Nb together. The mixture was sealed in a Cu can under vacuum and extruded to rod. The resulting alloy was then treated as in Example 1, with the same results.

EXAMPLE 1*b*

An alloy of 80% by volume of Cu and 20% by volume of Nb was prepared by mixing powders of Cu and Nb together. The mixture was compacted by either a combination of cold isostatic pressing (CIP) or hot isostatic pressing (HIP). The resulting alloy was then treated as in Example 1, with the same results.

EXAMPLE 2

An alloy sheet was prepared as described in Example 1, la or lb except that the niobium was replaced with chromium. The results were comparable, the alloy sheet after the heat treatment being coated with chromium.

EXAMPLE 3

An alloy sheet was prepared as in Examples 1 and 2, except that tantalum was substituted for the niobium or chromium. The results were comparable, the alloy sheet after the heat treatment being coated with a visually observable layer of tantalum.

EXAMPLE 4

The same procedure and alloy were used as in Example 1, except that the tube interior atmosphere was replaced with a vacuum to provide the inert atmosphere. The same results were obtained as in Example 1.

EXAMPLE 5

The procedures were the same as in Example 1, except that the amounts of niobium in the Cu-Nb alloys were, respectively, 10% and 30% by volume. The results were comparable, the niobium after the heat treatment visibly covering the exterior surfaces of the Cu-10% Nb and Cu-30% Nb sheets.

EXAMPLE 6

The procedure and alloy used were the same as in Example 1, except that the heat treating temperature employed was 6500° C. The results were comparable, the Cu-20% Nb sheet having a visually apparent coating of niobium.

EXAMPLE 7

The procedures and alloy were the same as in Example 1, with the exception that the heat treating temperature employed was 10000° C. The results obtained were comparable, the niobium forming a coating on the alloy sheet.

EXAMPLE 8

An alloy sheet of 80% by volume copper and 20% by volume niobium was prepared and heat treated by the method described in Example 1. The resulting alloy sheet with the niobium surface coatings of about 100 angstroms thickness was sealed in a quartz tube under a helium atmosphere at about 12 psi pressure. It was heated to 11000° C. for 2 hours and then furnace cooled. Analysis with an energy dispersive x-ray spectrometer showed the surface layer of niobium to have a thickness of about 1 micron. The configuration of the sheet appeared to be unchanged.

EXAMPLE 9

The procedures of Example 8 were employed, except that the alloy used was 80% by volume copper and 20% by volume tantalum. The results obtained were similar. The surfaces of the alloy sheet after the second heat treatment were coated with a layer of tantalum having a thickness of about 0.5 micron.

EXAMPLE 10

The procedures employed were the same as those used in Example 8, except that the alloy used was 80% by volume copper and 20% by volume chromium. The results were similar but a thicker coating was obtained. The chromium coatings on the alloy sheet after the second heat treatment had a thickness of about 10 microns.

EXAMPLE 11

The procedures and alloy employed were the same as those of Example 8, except that the alloy sheet in the second heat treatment was held at a temperature of 11000° C. for 15 minutes. The resulting chromium layer was about 2 microns in thickness.

EXAMPLE 12

The procedure and alloy employed were the same as Example 8, except that the sample in the second heat treatment was held at the temperature of 1100° C. for 15 hours. The thickness of the chromium layer was about 14 microns.

EXAMPLE 12*a*

The procedure employed was the same as all previous examples except that the RF was an alloy of 90% Nb-10% Mo.

EXAMPLE 13

The procedure and alloy employed were the same as in example 1, 1*a*, and 1*b*, except that after the 6hr hold at 800° C. the temperature was increased to 1100° C. and held for 2 hours. After cooling to room temperature the Nb thickness was 1 $\mu$ m.

EXAMPLE 14

An alloy is prepared as in example 1 or 1*b*, except that the as-fabricated alloy was not mechanically reduced. In this case the sample was held at 800° C. for longer times, 24 hours, before the Cu matrix was completely covered with 50Å of Nb.

EXAMPLE 15

The procedure employed was the same as Example 1, except that after the sample was coated with niobium, an electrode was attached and the sample was inserted into a sulfuric acid bath. A DC electric current was passed between the sample and electrode, thus oxidizing the niobium coatings on their outer surfaces.

EXAMPLE 16

The procedure employed was the same as Example 1 except that after the sample was coated with niobium, the sample was placed in a controlled atmosphere furnace and heated to 9500° C. under vacuum. An atmosphere of CO gas was then introduced into the furnace chamber and held for several hours. This formed niobium carbide on the outer surfaces of the niobium coatings.

We claim:

1. A method of modifying the surface properties of a copper-refractory metal body, said body having a copper matrix with particles of the refractory metal (RF) dispersed therein, said RF being selected from the group consisting of niobium, vanadium, tantalum, chromium, and molybdenum, or any combination of this group, comprising heating said body in an ambient atmosphere that is not reactive with the alloy and at a temperature effective for reducing the surface energy of said body, the heating temperature being above about 600° C. and below the liquidus temperature of the Cu matrix for a time at temperature to coat a surface of said body with a layer of RF, and the further heating said body at a temperature above said liquidus temperature for a time to increase the thickness of said layer.

2. A method of modifying the surface properties of a copper-refractory metal alloy body, said alloy body having a copper matrix with particles of the refractory metal (RF) dispersed therein, said RF being selected from the group consisting of niobium, vanadium, tantalum, chromium, molybdenum, and tungsten, or any combination of this group, comprising heating said body in an ambient atmosphere that is not reactive with the alloy and at a temperature effective for reducing the surface energy of said body to effect diffusion of the RF from inside the body to the surface of the body, including controlling the heating temperature above 600° C. and below the liquidus temperature of the Cu matrix for a time at temperature to purposefully and controllably coat a surface of said body with a layer of RF of at least 2 angstroms to impart chemical properties of the RF to the surface of said body, and further heating said body at a temperature above the liquidus temperature and below 1300° C. to increase the thickness of the RF layer.

3. The method of claim 2 in which said further heating of said body is conducted in an ambient atmosphere non-reactive with said RF coating.

4. The method of claim 2 in which said further heating is conducted without changing the shape of said body, the RF layer on the surface of said body formed during the initial heating assisting in maintaining the shape of said body during said further heating.

5. The method of claim 2 in which after the formation of said layer on said body it is subjected to a further heating at a temperature of from 1100° to 1250° C., said further heating being carried out in an ambient atmosphere non-reactive with said RF layer, said further heating being continued until the thickness of said RF layer has increased to at least 0.5 microns.

6. The method of claim 5 in which said heating to form said RF layer of at least 2 angstroms thickness is continued until said RF layer has a thickness of at least 100 angstroms, and said further heating is continued until the RF layer has a thickness of at least 1 micron.

7. The method of claim 5 in which said further heating is conducted without changing the shape of said body, the RF layer on the surfaces of said body formed during the initial heating assisting in maintaining the shape of said body during said second heating.

8. A method of modifying the surface properties of a copper-refractory metal body, said body having a copper matrix with particles of the refractory metal (RF) dispersed therein, said RF being selected from the group consisting of niobium, vanadium, tantalum, chromium, molybdenum, and tungsten, or any combination of said group, comprising heating said body in an ambient atmosphere that is not reactive with the alloy and at a temperature effective for reducing the surface energy of said body, the heating temperature being above about 600° C. and below the liquidus temperature of the Cu matrix for a time at temperature to coat a surface of said body with a layer of RF, and reacting said layer of RF to form a compound selected from the group consisting of an oxide, nitride, sulfide and carbide.

9. A method of modifying the surface properties of a copper-chromium alloy body having a copper matrix with chromium particles dispersed therein, comprising heating said body in an ambient atmosphere that is not reactive with the alloy and at a temperature effective for reducing the surface energy of said body to effect diffusion of the chromium from inside the body to the surface of the body, including controlling the heating temperature above 600° C. and below the liquidus temperature of the Cu matrix for a time at temperature to purposefully and controllably coat a surface of said body with a layer of chromium of at least 2 angstroms to impart chemical properties of the chromium to the surface of said body.

10. A method of modifying the surface properties of a copper-refractory metal alloy body, said alloy body having a copper matrix with particles of the refractory metal (RF) dispersed therein, said RF being selected from the group consisting of niobium, vanadium, tantalum, chromium, molybdenum, and tungsten, said alloy body including from 10 to 25 volume percent refractory metal (RF) in the form of filaments, comprising heating said body in an ambient atmosphere that is non-reactive with the alloy and at a temperature above 650° C. and below the liquidus of the Cu matrix for a time at temperature to purposefully and controllably coat the surface of said body with a layer of RF of at least 2 angstroms thickness to thereby impart chemical properties of the RF to the surface of said body.

11. The method of claim 10 in which said refractory metal is tungsten.

12. A method of modifying the surface properties of a copper-refractory metal body, said body having a copper matrix with particles of the refractory metal (RF) dispersed therein, said RF being selected from the group consisting of niobium, vanadium, tantalum, chromium, molybdenum, and tungsten, said body including from 10 to 25 volume percent refractory metal (RF) in the form of filaments, comprising heating said body in an ambient atmosphere that is non-reactive with the body and at a temperature above about 650° C. and below the liquidus of the Cu matrix and for a time at temperature to coat a surface of said body with a layer of RF of at least 2 angstroms thickness, and then further heating said body at a temperature above said liquidus temperature for a time to increase the thickness of said layer.

13. A method of modifying the surface properties of a copper-refractory metal body, said body having a copper matrix with particles of the refractory metal (RF) dispersed therein, said RF being selected from the group consisting of niobium, vanadium, tantalum, chromium, molybdenum, and tungsten, said body including from 10 to 25 volume percent refractory metal (RF) in the form of filaments, comprising heating said body in an ambient atmosphere that is non-reactive with the body and at a temperature above about 650° C. and below the liquidus of the Cu matrix for a time at temperature to coat a surface of said body with a layer of RF of at least 2 angstroms thickness, and reacting said layer of RF to form a compound selected from the group consisting of an oxide, nitride, sulfide and carbide.

* * * * *

UNITED STATES PATENT AND TRADEMARK OFFICE

CERTIFICATE OF CORRECTION

PATENT NO. : 5 252 147

DATED : October 12, 1993

INVENTOR(S) : John D. VERHOEVEN, et al

It is certified that error appears in the above-identified patent and that said Letters Patent is hereby corrected as shown below:

Column 9, line 7; replace "said group" with ---this group---.

Signed and Sealed this

Seventeenth Day of May, 1994

Bruce Lehman

*Attest:*

BRUCE LEHMAN

*Attesting Officer*

*Commissioner of Patents and Trademarks*